United States Patent [19]

Meyer et al.

[11] 4,177,991

[45] Dec. 11, 1979

[54] AMUSEMENT APPARATUS

[75] Inventors: Burton C. Meyer, Downers Grove; Palmer J. Schoenfield, Lake Forest, both of Ill.

[73] Assignee: Marvin Glass & Associates, Chicago, Ill.

[21] Appl. No.: 873,790

[22] Filed: Jan. 31, 1978

[51] Int. Cl.[2] ..... A63H 27/10

[52] U.S. Cl. ..... 273/95 B; 46/1 H; 46/77; 46/86 R

[58] Field of Search ..... 273/95 R, 95 A, 97 R, 273/98, 101, 95 AA, 95 B; 272/24, 31 R, 31 A, 31 B; 46/77, 79, 81, 86 R, 1 H

[56] References Cited

U.S. PATENT DOCUMENTS

| | | | |
|---|---|---|---|
| 2,388,513 | 11/1945 | Zwickel | 46/77 |
| 2,601,409 | 6/1952 | McArthur et al. | 46/77 X |
| 2,701,935 | 2/1955 | Florence | 46/86 R |
| 2,743,068 | 4/1956 | Walker | 46/77 X |
| 2,927,753 | 3/1960 | Feldman | 46/86 R X |
| 3,496,671 | 2/1970 | Korona | 46/86 R X |
| 3,600,843 | 8/1971 | Becker | 46/1 H |
| 3,864,868 | 2/1975 | Wolf | 46/1 H |
| 4,047,324 | 9/1977 | Wesenberg | 46/86 R |

FOREIGN PATENT DOCUMENTS

| | | | |
|---|---|---|---|
| 963339 | 7/1964 | United Kingdom | 46/1 H |

*Primary Examiner*—Richard J. Apley

*Attorney, Agent, or Firm*—Mason, Kolehmainen, Rathburn & Wyss

[57] ABSTRACT

An amusement game device includes an endless loop of elongated flexible cord having an upper and a lower run. A first pulley assembly is provided to support one end of the loop and is adapted to be connected to a relatively fixed object such as a door or piece of furniture. A hand held, movable control pulley assembly is provided to support the opposite end of the loop and includes a manually rotatable sheave for moving the cord of the runs toward and away from the fixed object. A trolley is supported for movement on the cord of one of the runs of the loop to move back and forth in response to rotation of the hand held pulley. A toy aerial balloon is carried by the trolley and includes a basket with a grappling hook hanging downwardly thereof for picking up various play objects in the surrounding play area as the aerial balloon is moved around by changing the position of the hand held control pulley and by rotating the control pulley to move a balloon back and forth along the run of the loop. Additionally, a releasable aerial toy such as a glider is supported from the trolley in ready position for release to free-flight when the trolley is moved to contact a stop which may be secured at any desired position along the length of the cord loop. During play, the hand held control pulley assembly is manipulated to control the position of the aerial balloon and grappling hook over the play area to pick up and carry various play objects included in the game apparatus.

14 Claims, 12 Drawing Figures

AMUSEMENT APPARATUS

BACKGROUND OF THE INVENTION

1. Field of the Invention

The present invention relates to a new and improved amusement apparatus or game device which is especially well adapted for use in play by children. The game is useful in improving manual skill, dexterity and muscular coordination of children during play and also provides an interesting and exciting pastime. The amusement game device includes a toy aerial balloon supported from a hand controllable trolley system so that the balloon may be manipulated to move over the play area to pick up and carry away various playing pieces.

2. Description of the Prior Art

A wide variety of game devices and toys have been developed around the theme of aircraft including aerial balloons, parachutes, airplanes, helicopters, rockets, satellites and the like. One balloon and parachute toy is shown and described in U.S. Pat. No. 4,047,324 issued Sept. 13, 1977. Many gasoline and/or electric motor powered model airplanes, including both free-flight and U-control types have been developed and the U-control type airplanes provide a hand held control apparatus for restricting and controlling the flight of a model airplane through elongated cords or control wires. As far as is known, none of the prior art devices provide a system wherein an aerial toy such as an aerial balloon is controlled for movement along an overhead trolley system with one end of the trolley adapted to be attached to an object such as a door or piece of furniture with the other end of the trolley being hand held for movement and control of the balloon as desired.

It is therefore an object of the present invention to provide a new and improved amusement apparatus of the character described.

More particularly, it is an object of the present invention to provide a new and improved amusement game device which includes an aerial toy supported on a trolley system for controlled movement between a hand held movable control unit and an opposite end of the trolley.

Yet another object of the present invention is to provide a new and improved amusement game apparatus of the character described wherein an aerial toy is carried on a trolley system and is selectively released for free-flight when desired.

Another object of the invention is to provide a new and improved amusement apparatus of the character described which is useful in improving a childs manual dexterity, skill and muscular coordination.

Yet another object of the present invention is to provide a new and improved amusement apparatus of the character described which is interesting, exciting and entertaining.

SUMMARY OF THE INVENTION

The foregoing and other objects and advantages of the present invention are accomplished in a new and improved amusement apparatus or game device which includes an endless loop of elongated flexible cord having an upper run and a lower run. A pulley assembly adjacent one end of the loop is adapted to be secured in detachable fashion to an object such as a door or piece of furniture to support an end of the loop and a hand held movable control unit having a pulley is provided at the opposite end of the loop. The control unit includes a rotatable pulley for moving the cord of the runs of the loop toward and away from the opposite supported end. A trolley is adapted to move along the runs of the loop as controlled by the movable control unit and a toy aerial balloon having a basket is carried by the trolley. A grappling hook is provided on the basket for picking up and releasing various play pieces or objects in the surrounding play area. An aerial toy such as a glider is supported on the trolley and is released for free-flight by engagement of the trolley with a stop which is mounted at a selected position on the loop.

In accordance with one feature of the invention, the basket of the toy aerial balloon is provided with a floor for supporting various objects carried in the basket and the floor is movable between a normal or flat position and an upstanding position. The floor is biased toward the upstanding position for ejecting the objects carried in the basket whenever the basket is brought into close proximity to a surface or object in the play area to trigger the release of the floor.

BRIEF DESCRIPTION OF THE DRAWINGS

For a better understanding of the present invention reference should be had to the following detailed description taken in conjunction with the drawings, in which.

DESCRIPTION OF THE PREFERRED EMBODIMENT

Figure 1:
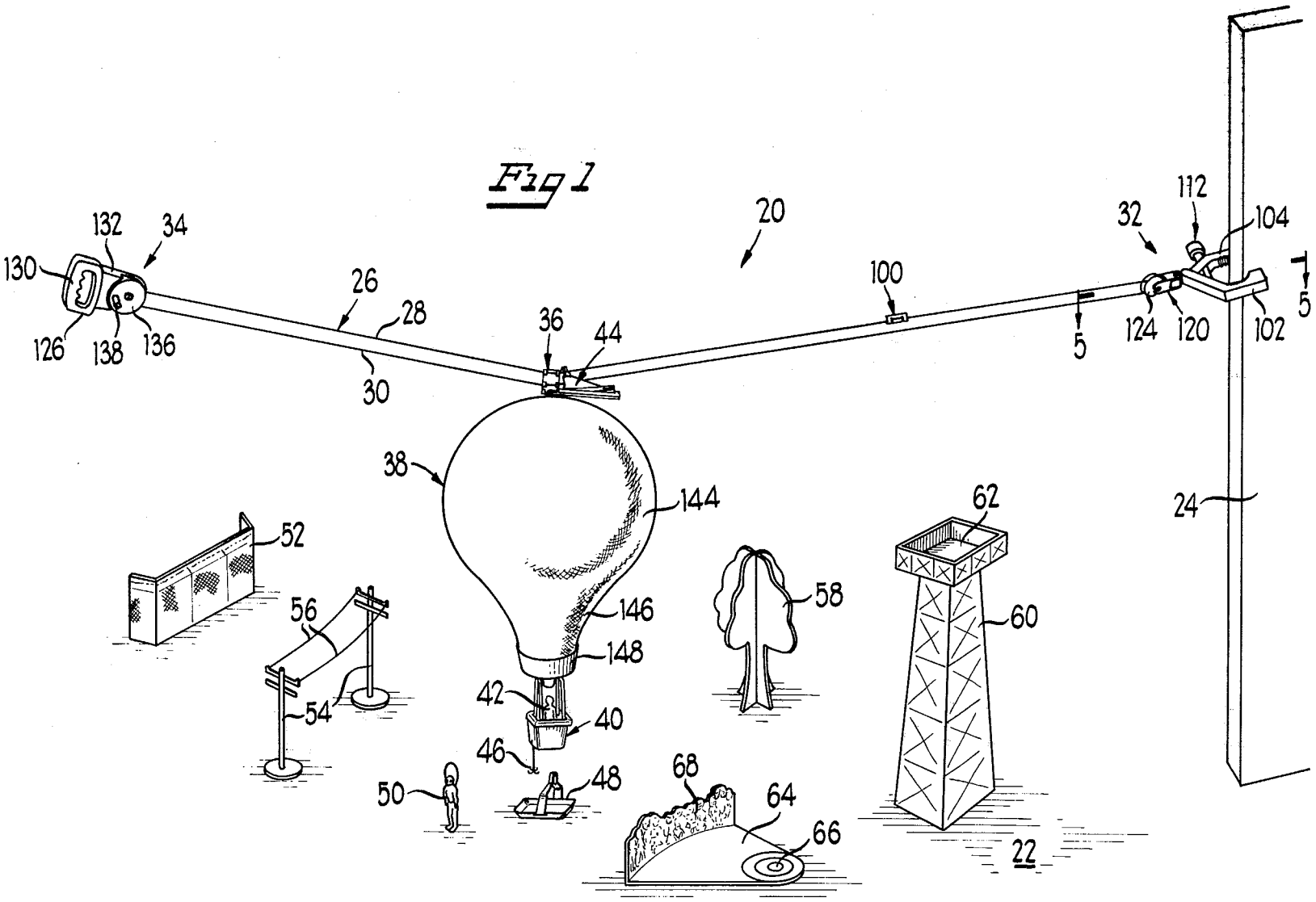
FIG. 1 is a perspective view of an amusement apparatus or game device constructed in accordance with the features of the present invention shown with various playing pieces in position for play in a play area.

Referring now more particularly to the drawings, in FIG. 1 is illustrated a new and improved amusement apparatus or game device constructed in accordance with the features of the present invention and referred to generally by the reference numeral 20. The game apparatus is especially well suited for use at play by young children and is helpful in developing motor skills, manual dexterity and muscular coordination, in addition to providing exciting entertainment and amusement for the child at play. The apparatus is adapted to be used in a play area having a relatively large playing surface or floor 22 and is used in conjunction with a relatively stationary object such as a door 24 or relatively fixed piece of furniture in the play area.

The game apparatus includes an endless loop 26 of elongated flexible cord or string having an upper run 28 and a lower run 30. One end of the endless loop is adapted to be detachably secured to the door 24 or other object at a selected height or elevation above the playing surface 22 by means of a relatively fixed pulley assembly 32 and the opposite end of the loop is movable and controlled by a hand held control unit 34 which is adapted to be manipulated by a player to change the slope and position of the runs of the loop as well as move the cords of the respective runs towards and away from the pulley assembly 32 which is secured to a relatively fixed object such as the door 24 during play.

A trolley 36 is supported on the endless loop 26 for movement along the runs thereof between opposite ends during play. The trolley is adapted to support a toy aerial balloon 38 having a hanging basket 40 which is suitable for carrying a toy figure such as a person 42 or various other play objects. In addition, the trolley provides a movable support station for an aerial glider 44 which may be released for free-flight as will be described hereinafter.

The basket 40 is provided with a grappling hook 46 hanging downwardly therefrom and the hook is adapted to engage and pick up various play objects such as a secondary basket or tray 48 and an additional toy figure or person 50 having a pick-up loop over the head. The game apparatus also includes other play pieces which may be randomly placed on the floor or playing surface 22 including a section of fencing 52, a pair of telephone poles 54 interconnected by telephone lines 56, a tree 58, a tower 60 having an observation platform 62 at the upper end large enough to support the basket 40 and a target element 64. The fan shaped target includes a bull's eye 66 at one end and an upstanding arcuate segment 68 decorated to represent a crowd of people watching to see if the basket 40 is accurately landed upon the center of the bull's eye.

In accordance with the invention, the trolley 36 is movable with and controlled by the cord of the lower run 30 of the endless loop and the lower run is positioned and controllable by means of the control unit 34. The trolley may be moved along the loop so that the man 50 or basket 48 can be picked up with the grappling hook 46 or the basket 40 may be brought to rest on the bull's eye 66 or on the observation platform 62 of the tower 60. The fence section 52, the wires 56 and the telephone poles 54 along with the tree 58 and the fence like portion 68 representing the crowd constitute obstructions to inhibit the free movement of the aerial balloon, basket and grappling hook thus requiring skill and dexterity in manipulation of the manual control unit 34 during play. Should one of these constructions be inadvertently engaged or knocked down by the basket or the grappling hook, penalty points or a subtraction of points from the score of the player may result according to the rules of play of the game.

Figures 2, 3:
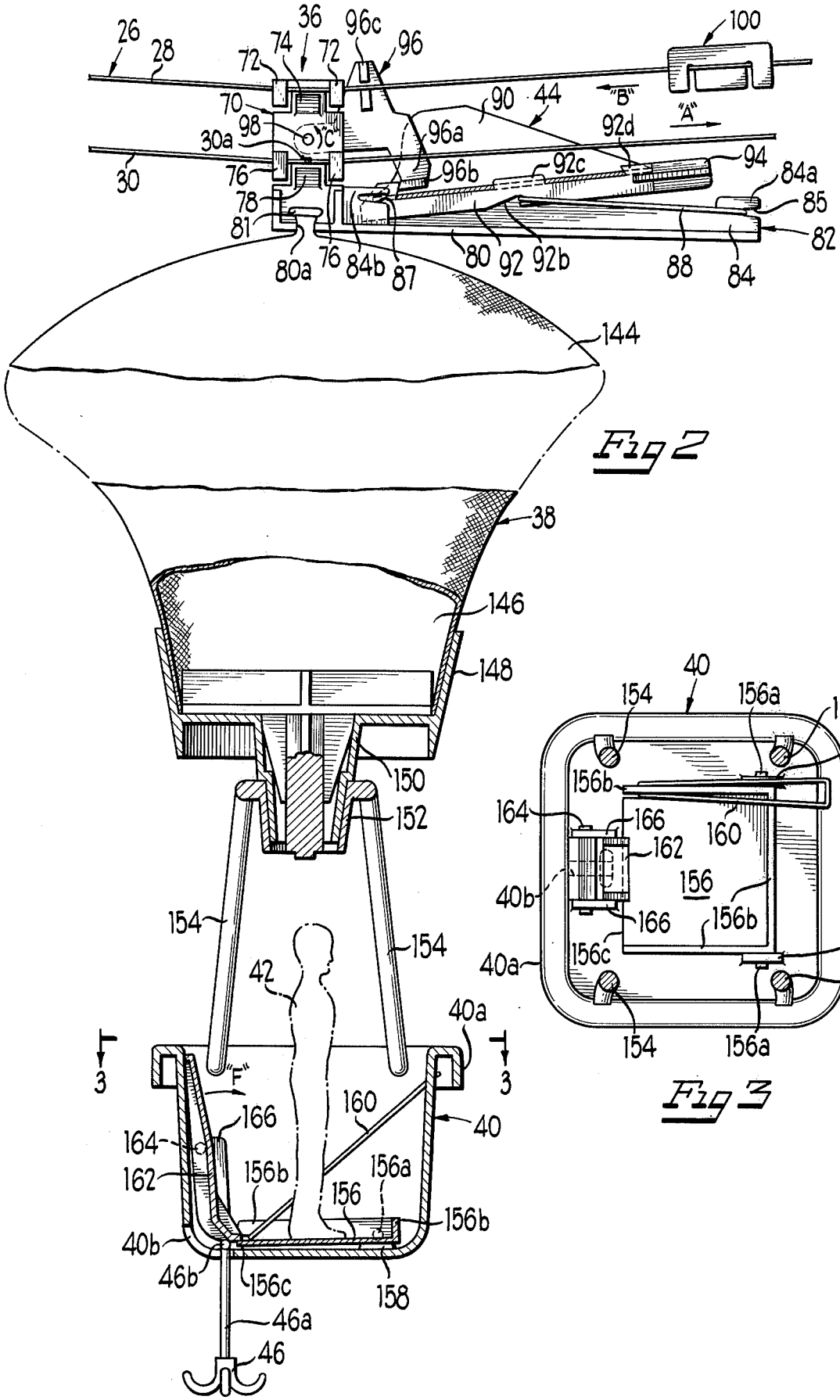
FIG. 2 is an enlarged, elevational view of a toy aerial balloon of the game apparatus with portions broken away and in section for a better understanding.
FIG. 3 is a horizontal, sectional view taken substantially along lines 3—3 of FIG. 2.
Figures 4, 5, 6:
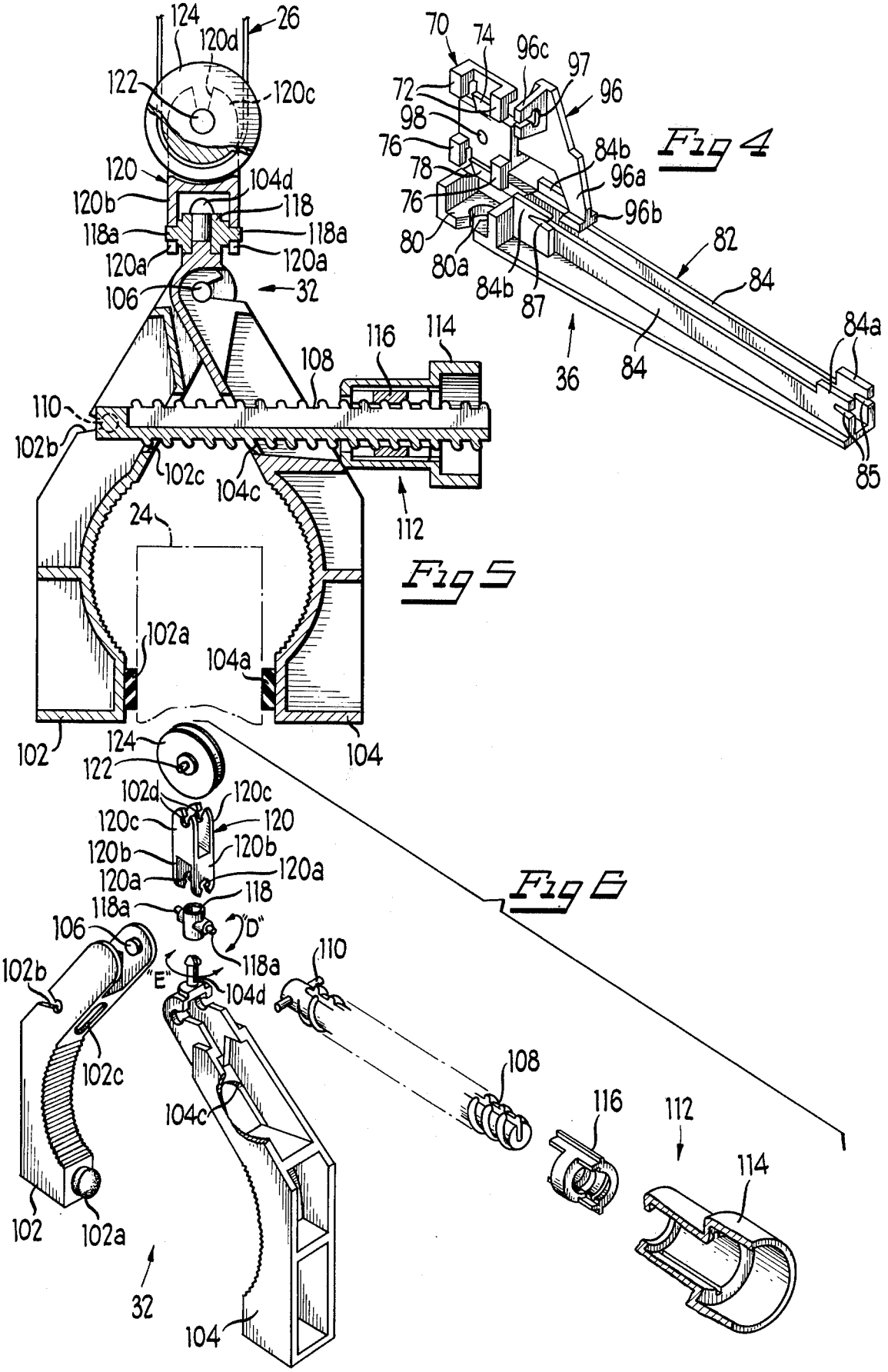
FIG. 4 is a perspective, elevational view of a portion of the trolley in accordance with the present invention.
FIG. 5 is a fragmentary, sectional view taken substantially along lines 5—5 of FIG. 1.
FIG. 6 is an exploded, perspective view of the apparatus of FIG. 5 with portions broken away and in section for clarity.

Referring now to FIGS. 2, 3 and 4, the trolley 36 is movable between opposite ends of the loop 26 and includes a body 70 having a pair of upper hooks 72 for retaining the body on the upper run 28. Additionally, a wedge-shaped element 74 is provided to insure that the cord of the upper run is positively retained within the depending upper hook fingers on the body. The trolley body also includes a pair of lower hooks 76 and a lower wedge 78, both of which function similarly to the upper set as described except that the lower set positively retains the lower portion of the trolley body of the lower run 30 of the cord loop. As the trolley moves back and forth between opposite ends of the loop, the upper hooks 72 slide freely along the upper run 28. The trolley body 70 is adapted to move with and be driven by the movement of the lower run 30 and accordingly, a knot 30*a* is provided in the cord of the lower run between the spaced lower hooks 76 to interlock the trolley to move with the cord. When the lower run is moved in the direction of the arrows "A" to the right as shown in FIG. 2, the trolley 36 also moves along with the cord of the lower run and the upper run of the cord moves in an opposite direction as indicated by the arrow "B".

Figure 10:
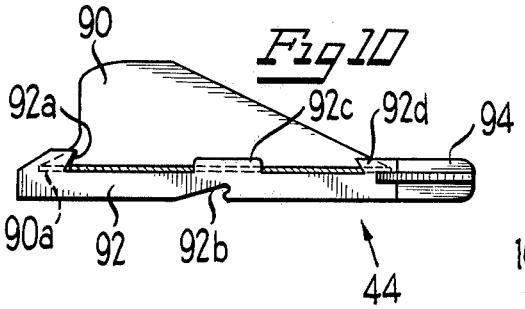
FIG. 10 is a longitudinal, sectional view taken substantially along lines 10—10 of FIG. 9.
Figure 9:
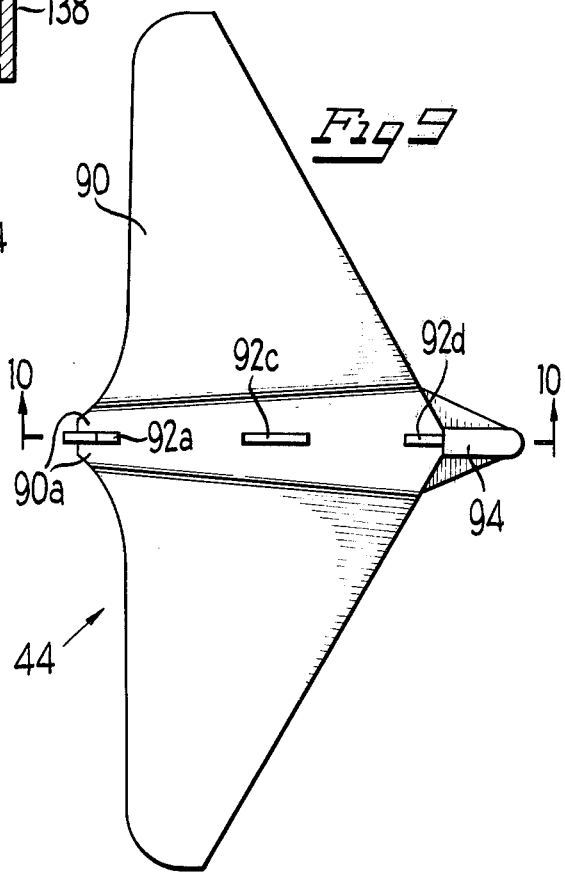
FIG. 9 is a top plan view of an aerial glider in accordance with the features of the present invention.
Figure 12:
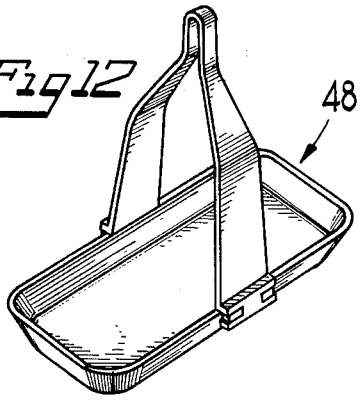
FIG. 12 is a perspective, view of an auxiliary lift basket in accordance with the features of the present invention.

At the lower end below the lower run 30, the trolley base 70 is provided with a bottom wall 80 having a key-hole shaped opening 80*a* therein (FIG. 4) for receiving a button-like connector 81 positioned at the center on the upper spherical surface of the toy aerial balloon 38. If desired, the aerial balloon may be readily detached from the trolley. As shown in FIGS. 2 and 4, the bottom wall 80 of the trolley body 70 extends laterally outwardly in one direction from the opening 80*a* to provide a bottom or web portion of a channel-shaped launching guide or track 82 having a pair of upstanding side walls 84 which form a launching guideway for the aerial glider 44. The upstanding side walls of the launch track are adapted to guide the opposite sides of a fuselage portion of the glider 44 as the glider is launched or released for free-flight during play. The side walls 84 are provided with upstanding outer end portions 84*a* having outwardly opening slots 85 formed therein which are adapted to accommodate the outer end of a rubberband 88 which is stretched in tension ready to supply the power for launching the glider along the track when released. At the inner end, the launch track is formed with a pair of upstanding stop elements 84*b* having outwardly opening slots 87 and the slots are adapted to engage and retain a rail or central trailing edge portion 90*a* of a bat-like wing 90 of the glider (FIGS. 9 and 10).

In addition to the bat-shaped wing 90, the glider includes an elongated fuselage 92 having an upstanding tail segment 92*a* adapted to be centered between the stop portions 84*b* of the launching guideway 82 when the glider is in a position ready for launching. Along the lower edge, the fuselage 92 is formed with a recess or notch 92*b* for accommodating the inner end of the rubberband 88.

In order to provide the desired flight characteristics, the glider 44 includes a thickened nose section 94 and the fuselage 92 is joined to the bat-shaped wing 90 along a central, longitudinal axis of the glider by means of the upwardly projecting tail segment 92*a*, an intermediate upstanding tab 92*c* spaced above the notch 92*b* (FIG. 10), and a forward or nose end tab segment 92*d*. The upstanding projections 92*a*, 92*c* and 92*d* extend upwardly through slots or openings formed in the central portion of the bat-shaped wing 90 of the glider. As shown in FIG. 10, the opposed, facing edge surfaces of the nose and tail segments provide a positive interlocking relation between the fuselage and the wing of the glider. When the glider is set in the ready position (FIG. 2), the rubberband 88 is stretched in tension and the rear end or trailing edge portions 90*a* of the wing is seated within the notches 87 of the stops 84*b* on the launch guideway side walls 84. The glider is retained in this position by means of a latch 96 pivotally secured to the trolley body 70 and a pivot pin 98 as best shown in FIGS. 2 and 4. The glider release latch includes a downwardly extending finger 96*a* having a foot or pawl portion 96*b* at the lower end adapted to latchingly engage the outwardly facing edge of the upstanding tail section 92*a* of the glider fuselage. The latch element also includes an upstanding portion finger having a laterally extending tab 96*c* which acts as a trigger for pivoting the latch element 96 in a counterclockwise direction as indicated by the arrows "C" in FIG. 2, to move the pawl 96*b* out of engagement with the tail section 92*a* of the glider and thereby release the glider to be launched along the guideway 82 by the force of the rubberband 88. When the glider is so released, the fuselage 92 is guided between the upstanding walls 84 to provide good directional control during the launching phase. The actuating tab or trigger 96*c* of the latch is formed with a key-hole shaped opening 97 to accommodate the upper run 28 of the cord loop.

Figure 11:
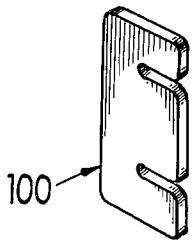
FIG. 11 is a perspective, elevational view of a stop element for the endless cord loop in accordance with the features of the present invention.

In order to release and launch the glider 44 for free-flight as shown in FIG. 2, the hand held control unit 34 is manipulated to move the lower cord run 30 in a direction toward a stop element 100 (FIGS. 1 and 11) which is mounted on the upper cord. As this occurs, the trolley 36 moves in one direction (arrow "A") while the upper cord run 28 carrying the stop moves in an opposite direction toward the trolley as indicated by the arrow "B". The "E"-shaped stop 100 may be secured on the upper run 28 at any selected position thereon over the play area 22 to effect release and launch of the glider at the desired location. When the tab or trigger portion 96*c* of the latch 96 contacts an end of the stop 100, the latch is pivoted in a counterclockwise direction about the pivot pin 98 so that the pawl 96*b* moves out of retaining engagement with the tail section 92*a* of the glider fuselage. When this occurs, the rubberband 88 is then effective to launch the glider into free-flight to glide back to land on the play surface 22. The "E"-shaped stop element is formed of a flat sheet of plastic material and may be readily repositioned at any selected location along the upper run 28 of the cord loop. The side walls 84 of the launching guideway 82 provides directional control for the fuselage 92 of the glider during the launch and the skill of a player may be reflected by properly determining in advance, the point at which the glider will be launched so that it will come to rest after its free-flight on a particular area of the play surface 22.

Referring now to FIGS. 5 and 6, the elevation or distance of the cord loop 26 above the playing surface 22 is selectively controlled at one end of the loop 26 by the height or distance above the play surface that the fixed end pulley assembly 32 is attached onto the edge of the door 24 or other appropriate piece of furniture. The fixed end pulley assembly includes a pair of clamping jaws 102 and 104 which are pivotally interconnected by means of a pivot pin 106. Preferably, the clamping jaws are formed of molded plastic material and are of generally channel-shaped transverse cross-section with cushion pads 102*a* and 104*a* at the outer end provided to prevent damage to the door or furniture when the clamping jaws are attached thereto. In order to provide a positive clamping pressure between the clamping jaws there is provided an elongated screw element 108 having a retaining pin 110 at one end seated within a notched out recess 102*b* in the side flanges of the clamping jaw 102. The screw element extends through elongated openings or slots 102*c* and 104*c* respectively, in the opposed facing web portions of the respective clamping jaws. A knob or hand wheel assembly 112 including an outer sleeve 114 and an internally threaded inner sleeve 116 is mounted on the right hand outwardly extending end portion of the threaded screw elements 108. The internally threaded inside sleeve 116 is keyed to the outer sleeve 114 of the knob assembly to turn therewith and when the knob assembly is rotated in a clockwise direction, the inner face of the sleeve 114 moves against the outer edges of the flanges on the clamping jaw 104 to close the jaws toward one another and provide clamping force on opposite edges of the door. The clamping pressure is released by a counterclockwise rotation of the knob assembly 112 so that the jaws may spread apart and open up.

In order that the clamping jaw assembly may be attached to a variety of different objects, extending horizontally, diagonally and/or vertically, the clamping jaw 104 is provided with a swivel mounting pin 104*d* which is split longitudinally and is extended into the central bore of a toggle-like universal joint element 118. The toggle element includes a pair of oppositely outwardly extending stub axles 118*a* which are seated for pivotal movement in key-hole shaped openings 120*a* formed in a pair of spaced apart side members 120*b* of a sheave support base 120. With the opposite axle portions 118*a* seated within the circular portions 120*a* of the openings in toggle base 120, the toggle is permitted to rotate freely around the axis of the stub axles as indicated by the arrow "D". At the same time, the headed pivot pin 104*d* provides full swivel action between the clamping jaw 104 and the toggle 118 permits rotation of the clamping jaw assembly in a transverse plane as indicated by the arrow "E". The universal joint type permits the fixed end pulley assembly 32 to be clamped to almost any type of furniture leg or base or structure such as a door or door jamb. The base 120 includes a second pair of spaced apart side members 120*c* with key-hole shaped openings 120*d* formed in the outer ends. These openings accommodate an axle 122 of a sheave or pulley 124 having a V-groove in the circumference therein for accommodating the cord of the belt loop 26. From the foregoing it will be seen that the fixed end pulley assembly 12 permits one end of the belt loop 26 to be attached to an almost infinite variety of objects available around the house and permits an easy release when play is over. The toggle element 118 provides a full swivel connection so that the angular orientation between the endless belt loop 26 and a stationary object is virtually unlimited.

Figure 7:
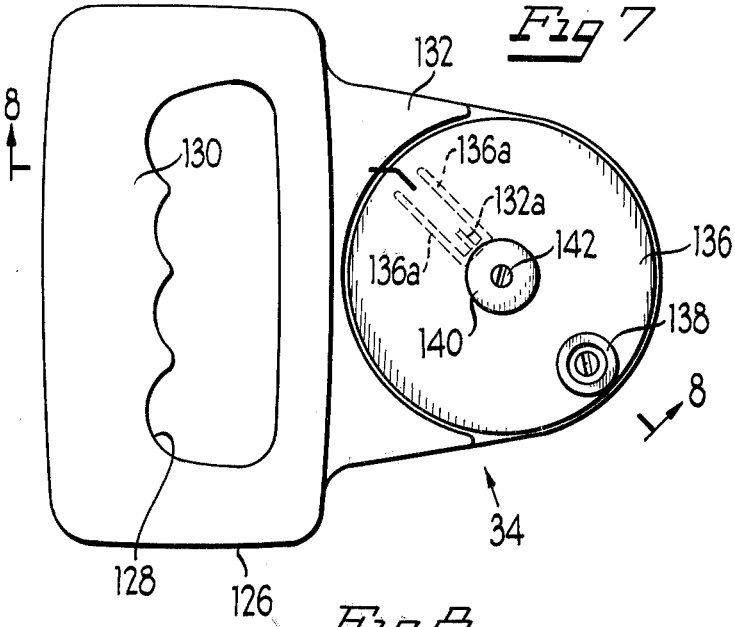
FIG. 7 is an enlarged, side elevational view of a hand held control unit for supporting and controlling one end of a loop of elongated flexible cord used for supporting the trolley in accordance with the features of the present invention.
Figure 8:
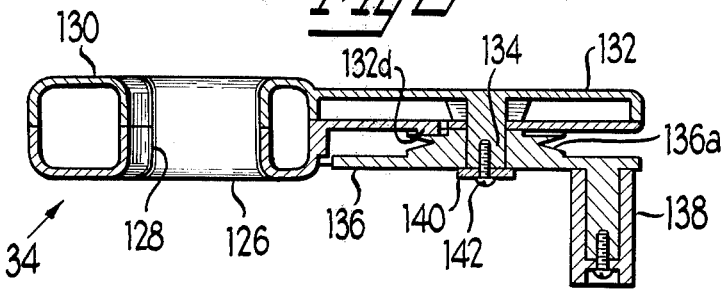
FIG. 8 is a sectional view taken substantially along line 8—8 of FIG. 7.

The manual control unit 34 at the opposite end of the cord loop includes a hollow base 126 formed by a pair of mating halves and formed with a relatively large finger opening 128 to provide for easy grasping of an outer handle portion 130 as best shown in FIGS. 7 and 8. The base includes a thinner portion 132 extending toward an opposite end of the cord loop and having an integral transverse axle pin 134 thereon. A control sheave or pulley 136 is mounted on the axle pin and has an eccentric crank handle 138 to facilitate manual rotation of the pulley. The pulley includes a flat outer face and an inside V-groove sheave portion 136*a* for accommodating the cord of the endless belt loop 26. The sheave is retained in the axle pin 134 by means of a washer 140 and cap screw 142 and when the eccentric crank handle 138 is rotated, the trolley 36 moves toward or away from opposite ends of the loop as determined by the direction of crank rotation. The overhead position of the trolley 36 relative to the play surface 22 may also be changed by and controlled by movement of the entire control unit 34 as desired. As illustrated in FIGS. 7 and 8, an inside face of the pulley or sheave 136 is formed with a pair of spaced apart ribs 136*a* extending outwardly of the axle and these ribs are adapted to engage a deflectable rib 132*a* formed on the adjacent facing surface of the forward portion 132 of the handle structure. Whenever the eccentric crank handle 138 is released, engagement between the ribs 136*a* and 132*a* prevents the sheave from rotating more than a portion of one turn. During a hand cranking operation the contact and deflection of the ribs makes an audible clicking sound which is useful in counting the number of revolutions of the crank that is required to move the trolley 36 a selected distance.

Referring now to FIGS. 1 and 2, the toy aerial balloon 38 includes a spherical upper portion 144 suspended from the trolley base 70 by the button-like swivel element 81. The balloon includes a generally frusto-conically shaped lower skirt portion 146 and a frusto-conical base 148 at the lower end. The base 148 includes an axially aligned downwardly depending stepped frusto-conical central bearing segment 150 which provides a swivel mounting for a frusto-conical support ring 152 mounted to support a plurality of downwardly depending basket support members 154. At the lower end, the basket support members are interconnected to the inside surfaces of opposite sidewalls of the basket which is preferably formed of integrally molded plastic material with a generally square shaped horizontal cross-section. The basket includes a downturned peripheral lip 40*a* around the upper edges of the sidewalls. As illustrated in FIG. 2, the spacing between the support elements 154 is sufficient to permit the toy figure 42 or other object to be moved freely into and out of the basket in either a forward or rearward direction. As previously indicated, the basket provides support for a grappling hook 46 having an upstanding shank 46*a* which projects through a key-hole shaped slot 40*b* formed in the bottom wall and one side wall of the basket as illustrated. At the upper end of the shank 46*a* there is provided a cross-member or "T"-handle 46*b* which loosely secures the grappling hook to the basket.

In accordance with a feature of the present invention, the aerial basket 40 is provided with an auxiliary floor 156 for supporting the toy figurine 42 or other object in the basket and the floor is pivotally secured onto a pair of upstanding legs 158 which are integrally formed on the bottom wall. The floor includes a pair of stub axles 156*a* extending oppositely outwardly into the upstanding brackets which serves as bearings therefor as illustrated in FIGS. 2 and 3. The floor 156 is pivotal between a flat or normal position as illustrated and an upstanding position and the floor is biased toward the upstanding portion by a tensioned rubberband 160 having an upper end connected to a side wall portion of the basket and an opposite end connected to a notch in an edge wall 156*b* which is integrally formed around three sides of the periphery of the floor. The floor includes a free outer edge portion 156*c* on the fourth sides and this edge portion is normally engaged by a pivotal latching element 162 mounted on a pin 164 extending between a pair of support brackets 166 on the basket sidewall.

When the aerial balloon 38 is manipulated in order to pick up various objects with the grappling hook 46, the hook is in a dangling position as shown in FIGS. 1 and 2 and at times, the lower end may inadvertently or intentionally engage various objects in the play area. Should the tines of the hook engage obstructions such as the fence sections 52, the telephone wires 56 or poles 54, the tree 58 or the tower 60 and observation platform 62, the hook will tend to pivot outwardly toward the horizontal until the obstruction is cleared or the hook will pick up the obstruction and carry it along. The tines of the hook are also used with the balloon for picking up the toy person 50 or the tray 48.

When the basket 40 is lowered onto a flat surface such as the play surface 22, or the bottom of the observation platform 62 on the tower 60, or on the bull's eye 66 of the target element 64, the grappling hook is forced upwardly relative to the basket as the contact is made. As this occurs, the "T"-handle 46*b* slides upwardly in the basket between the side edges of the latch element and the inside surface of the adjacent basket side wall. After the "T"-handle passes above the mounting axle 164 it engages the upper portion of the latch element and then causes the latch to pivot in a clockwise direction as indicated by the arrow "F". When this occurs, the lower end of the latch is released from engagement with the free edge 156*c* of the floor and the rubberband 160 rapidly pivots the floor to an upright position. This action ejects the toy figure 42 or other object from the basket on a trajectory extending upwardly and outwardly between the basket support members 154. This ejection action simulates an occupant of the balloon basket dismounting or bailing out as the balloon comes to rest on an adjacent surface.

From the foregoing it will be seen that the game apparatus of the present invention may provide many hours of entertainment and amusement for both children and adults. In addition, during operation of the apparatus, a child's motor skills, manual dexterity and muscular coordination may be improved along with the pleasant experience of play.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An amusement apparatus comprising:

an endless loop of elongated flexible cord including an upper run and a lower run;

pulley means adjacent one end of said loop adapted to be detachably connected to an object for permitting movement of the cord of said runs toward and away from said object;

hand held movable control pulley means adjacent an opposite end of said loop including rotatable means for moving the cord of said runs toward and away from said object;

trolley means supported from said endless loop connected for movement along with the cord of one of said runs to move between said object and said control pulley means;

an aerial toy releasably supported from said trolley means and stop means on one of said runs engageable to release said toy from said trolley; and support means carried by said trolley means including a support for holding a portion of said aerial toy in position ready for release, resilient biasing means for propelling said aerial toy outwardly away from said support when released and trigger means for retaining said aerial toy in said ready position and operable to release said aerial toy to be propelled outwardly by said biasing means when said trigger means engages said stop means.

2. The apparatus of claim 1 wherein said aerial toy comprises a glider.

3. The apparatus of claim 1 wherein said biasing means includes an elongated resilient member having one end attached to said glider support means and an opposite end adapted to be releasably attached to said glider.

4. The apparatus of claim 1 wherein said glider support means includes an elongated guideway for directing said glider outwardly from said ready position when said trigger means is released.

5. The apparatus of claim 4 wherein said toy includes a wing and a fuselage, said fuselage adapted to move along said guideway for guidance when said glider is released.

6. The apparatus of claim 4 wherein said support includes a stop for engaging a trailing edge of said toy wing when said is in said ready position, and wherein said trigger means includes a pawl engageable to hold said against said stop of said support and movable out of engagement to release said glider.

7. The apparatus of claim 6 wherein said toy includes a stop for engagement with said pawl to retain said glider in said ready position until said trigger means is released.

8. An amusement apparatus, comprising:

an endless loop of elongated flexible cord including an upper run and a lower run;

pulley means adjacent one end of said loop adapted to be detachably connected to an object for permitting movement of the cord of said runs toward and away from said object;

hand held movable control pulley means adjacent an opposite end of said loop including rotatable means for moving the cord of said runs toward and away from said object;

trolley means supported from said endless loop connected for movement along with the cord of one of said runs to move between said objects and said control pulley means;

a toy aerial balloon including a basket supported from said trolley means for movement therewith; and loop means supported from said basket for picking up objects from a surrounding playing surface as said aerial balloon is moved with said trolley, said basket including an upstanding side wall and a floor for supporting objects carried therein, said floor being pivotal between a normal position forming a bottom for said basket and an upstanding position adjacent said side wall, means biasing said floor toward said upstanding position to eject objects from said basket when received from said normal position, and releasable latch means for normally retaining said floor in said normal position.

9. The apparatus of claim 8 wherein said loop means includes a shank portion extending into said basket and operable to release said latch means when said basket is lowered toward an adjacent surface forcing said shank upwardly along said side wall.

10. The apparatus of claim 8 wherein said loop means includes a shank supported for pivotal movement in said basket.

11. The apparatus of claim 8 including a second basket having support arm means thereon for lifting the same when engaged by said hook means.

12. An amusement apparatus, comprising:

an endless loop of elongated flexible cord including an upper run and a lower run;

pulley means adjacent one end of said loop adapted to be detachably connected to an object for permitting movement of the cord of said runs toward and away from said object;

hand held movable control pulley means adjacent an opposite end of said loop including rotatable means for moving the cord of said runs toward and away from said object;

trolley means supported from said endless loop connected for movement along with the cord of one of said runs to move between said object and said control pulley means;

said pulley means adjacent one end of said loop including adjustable clamping means for attachment to an object, a body interconnected with said clamping means and a pulley sheave pivotally mounted on said body for rotation to support said moving cord of said runs.

13. The apparatus of claim 12 wherein said clamping means includes a pair of pivotally interconnected jaws and screw means for adjusting the spacing between gripping portions of said jaws.

14. The apparatus of claim 12 including connector means pivotally interconnecting said body and said clamping means.

* * * * *